United States Patent [19]

Ohtani

[11] 4,256,398

[45] Mar. 17, 1981

[54] DOUBLE SURFACED DEVELOPING TANK

[75] Inventor: Masami Ohtani, Kyoto, Japan

[73] Assignee: Dainippon Screen Seizo Kabushiki Kaisha, Kyoto, Japan

[21] Appl. No.: 25,403

[22] Filed: Mar. 30, 1979

[30] Foreign Application Priority Data

Apr. 12, 1978 [JP] Japan ..... 53/47965[U]

[51] Int. Cl.[3] ..... G03D 3/08

[52] U.S. Cl. ..... 354/320; 354/338; 226/196; 134/122 P

[58] Field of Search ..... 354/316, 320, 321, 322, 354/331, 338, 339; 134/64 P, 104, 122 P, 154, 182; 226/118, 196, 199; 118/419, 428

[56] References Cited

U.S. PATENT DOCUMENTS

| | | | |
|---|---|---|---|
| 2,786,401 | 3/1957 | Briggs et al. | 354/320 |
| 2,989,914 | 6/1961 | Reick | 354/338 |
| 3,000,289 | 9/1961 | Horiuchi | 354/322 |
| 3,388,688 | 6/1968 | Stanton | 354/322 |
| 3,468,693 | 9/1969 | Hanson | 354/320 |
| 3,678,842 | 6/1972 | Reid | 134/64 P |
| 3,881,329 | 5/1975 | Passler et al. | 354/339 |
| 4,130,825 | 12/1978 | Fasano | 354/322 |
| 4,151,942 | 5/1979 | Hope et al. | 354/339 X |

*Primary Examiner*—Joseph W. Hartary
*Assistant Examiner*—Alan Mathews
*Attorney, Agent, or Firm*—Zarley, McKee, Thomte, Voorhees & Sease

[57] ABSTRACT

A developing tank wherein means is provided to divide the surface of the developer charged into the tank into two separate portions, into one of which the film enters as it enters the developer, and out of the other of which the film leaves as it leaves the developer. Thus the contaminants and exhausted developer accumulating at the point where the film leaves the developer are prevented from directly moving along the surface of the developer to the point where the film enters the developer, and thereby streaking and uneven development are substantially reduced. The dividing means may be combined with a film entry guide plate.

4 Claims, 4 Drawing Figures

DOUBLE SURFACED DEVELOPING TANK

BACKGROUND OF THE INVENTION

This invention relates to an automatic film developer, and more particularly relates to an automatic film developer which prevents uneven finish during development.

In an automatic film developer, a film which has been exposed is successively passed through a developing tank, a fixing tank, a washing tank, and a drying tank, by a conveyor. In order to provide uniform development, the developing time, temperature, and concentration should always be maintained within certain ranges.

However, in such an automatic film developer, uneven developing finish is sometimes liable to occur, especially with certain kinds of films and developing agents. One of the causes of this is the partial changing of the nature of the fluid in the developing tank. This partial changing is especially apt to occur near the surface of the developing liquid.

This is because of two reasons. One is that oxidation of the developing liquid by air occurs at its surface. The other is because when the developed film is being taken out of the developing tank the developing liquid attached to the film is squeezed off it, and this liquid is thereby exposed to air, and also, because it has been in contact with the film for a long time, it contains a high concentration of free bromine radicals which are isolated from the halogenated silver layer of the film by the reducing agent. Thus the surface of the developing liquid in the tank is liable to be rather different in composition from the fresh developer in the rest of the tank. This is particularly noticeable at the point where the film leaves the tank, where, as explained above, contamination is at its worst. Mixing of this contaminated surface layer cannot be done immediately with the rest of the developer in the tank. Thereby uneven finish in the film's development can occur.

The effect of the contamination of the surface layer is particularly strong at the point where the film enters the tank. Here it is dry, and the very first developer with which it comes into contact, to which it is highly susceptible, owing to its dryness, is this contaminated and non-fresh developer. By this so-called "wetting shock", particularly, uneven finish is caused.

A countermeasure against this which has been practiced is to mix the developer strongly. But, in practice, it has proved almost impossible to mix the developer strongly enough and fast enough, in the restricted space available inside a developing tank, to completely obviate the streaking and uneven finish problem.

SUMMARY OF THE INVENTION

I have noticed that the contamination of this surface layer, as explained above, is chiefly originated at the place where the film leaves the developer, and that the undesirable action of this surface contamination particularly works at the place where the film enters the developer. Therefore, it has occurred to me to separate the surface layer, in between these two places, so as to stop the spread of the contamination from the one place to the other.

Therefore, it is an object of the present invention to provide a film developing tank for use in a film developer, which is free from the streaking and uneven finish problem.

In accordance with the present invention, this object is accomplished by a film developing tank, comprising a conveyor means for transferring a film to be developed into, through, and out of the tank, characterized in that the surface of the developing liquid, when such liquid is charged into the tank in the operating amount, is divided into two separate portions, the film being fed into one portion of the surface into the tank, and taken out of the tank out of the other portion of the surface.

BRIEF DESCRIPTION OF THE DRAWINGS

The present invention will become more fully understood from the following description of some preferred embodiments thereof, taken in conjunction with the accompanying drawings. However, it should be clearly understood that the descriptions of the embodiments, and the drawings, are given for the purposes of illustration only, and are not intended in any way to limit the scope of the present invention, which is intended to be defined solely by the claims. In the drawings:

DESCRIPTION OF THE PREFERRED EMBODIMENTS

Figure 1:
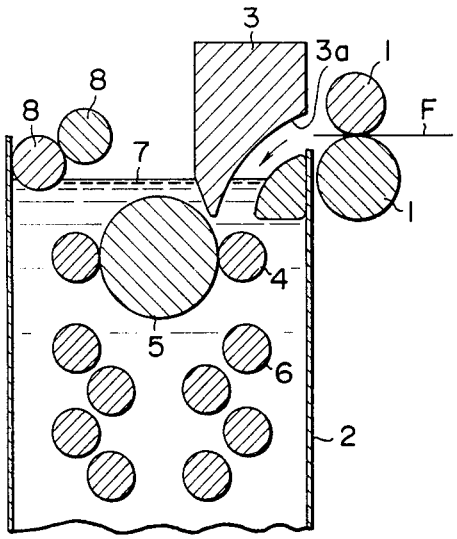
FIG. 1 PRIOR ART
FIG. 1 is a fragmentary longitudinal cross-section, in a schematic form, of the upper portion of a developing tank of a conventional automatic film developer.

Referring to FIG. 1, there is shown a conventional developing tank 2 (only the upper portion is shown). A film F is fed by feed rollers 1 along an arc-shaped front surface 3*a* of a guide member 3, downwards into the developing liquid 7, and in between transfer rollers 4 and 5. Then the film passes between further transfer rollers 6, and after being conveyed down a path towards the bottom of the tank its moving direction is reversed, so that it comes upwards out of the developing liquid 7, is squeegeed by squeegee rollers 8, and is then sent to a fixing tank.

In such a conventional machine the guide member 3 does not divide the surface of the developer into two; that is, it does not extend fully across the developing tank in the direction perpendicular to the drawing paper; or, alternatively, it is not continuous, but has gaps in its extent in the direction perpendicular to the paper. In either case, it is easy for contaminated developer squeegeed off from the film by the squeegee rollers 8 to flow along or near the surface of the developer to the place where the film is entering the developer, thereby causing streaking and uneven development.

Figure 2:
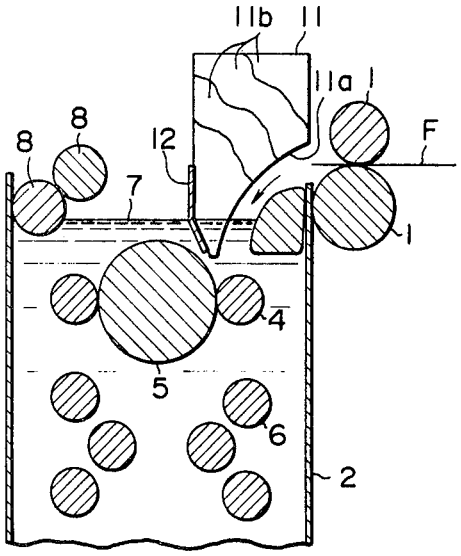
FIG. 2 is a fragmentary longitudinal cross-section, in a schematic form, of the upper portion of a developing tank of an automatic film developer, according to the present invention.

In FIG. 2 there is shown a developing tank according to the present invention. The essential difference of this tank is that the guide member 3 of the conventional tank is replaced by a guide member 11, which is made of a set of guide plates 11*b*, which lie in corresponding positions in the direction perpendicular to the plane of the paper and therefore appear as superimposed in the drawing, and further comprises a partition plate 12. Each of the guide plates 11*b* has an arc-shaped edge 11*a*, which therefore co-operate to define a guiding surface for the film which only contacts a small part of the surface of the film. The partition plate 12 is attached to the rear sides of the guide plates 11*b*, and extends completely across the developing tank, thereby dividing the horizontal section of the tank, at a certain height, into two, and thereby also dividing the surface of the developer charged into the tank into two. Thus the contaminated developer which is accumulated in and around the surface of the developer, to the left hand side of the plate 12 in the figure, is positively prevented from getting to the right hand side of the plate 12 in the figure, without moving along a lengthy path through the body of the developing fluid, which will thereby dilute it. Thereby the part of the developing fluid into which the film enters at first is maintained as pure as possible.

Other members illustrated in FIG. 2 correspond to members with the same reference numbers in FIG. 1.

Of course, the plate 12 could be provided separately from the guide plates 11*b*. The important thing is that this partition plate should extend completely across the tank.

Figure 3:
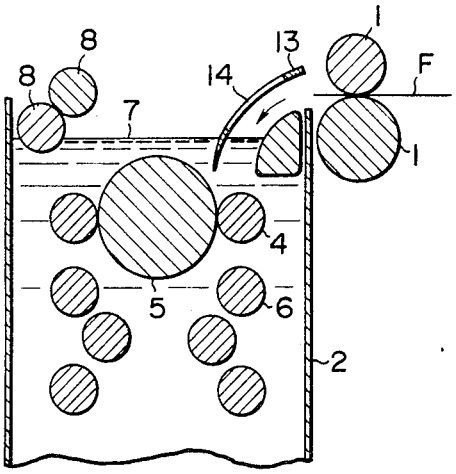
FIG. 3 is a view, similar to FIG. 2, showing the upper portion of the developing tank of another developing tank of another automatic film developer according to the present invention.
Figure 4:
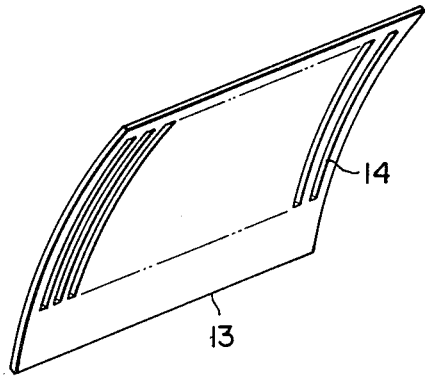
FIG. 4 is a perspective view of a guide and partition plate of the developing tank shown in FIG. 3.

In FIG. 3 is shown another developing tank according to the present invention. This is the same as the one of FIG. 2, except that the guide member 11 is replaced by a guide and partition plate 13, which again extends across the entire width of the tank in the direction perpendicular to the drawing paper. Therefore, again, the surface of the developer is divided into two parts which are not in communication. This guide and partition plate 13, as may be seen in FIG. 4, is provided with a plurality of elongated slits, designated by 14, directed substantially parallel to the direction of movement of said film, which thus ensure that the film only contacts a small part of the surface of the guide plate 13 above the surface of the developer as it is being guided into the developer. This is so as to reduce the chance of the film being stuck to the guide plate, or scratched thereby. Of course the slits 14 do not extend so far down the plate 13 as to dip into the developer.

Although the present invention has been shown and described with respect to some preferred embodiments thereof, it should be understood that various changes and modifications of the form and the content thereof may be made by a person skilled in the art, without departing from the scope of the present invention, which is therefore intended to be defined solely by the appended claims.

What is claimed is:

1. A film developing tank having a conveyor means which comprises a guide member having front and rear surfaces, feeding rollers by which a film to be developed is fed along the front surface of said guide member to introduce said film into developing liquid in said developing tank, and squeezing rollers for squeezing said film characterized in that:

said guide member is made of a plurality of spaced-apart guide plates each of which has a rear edge and an arc-shaped front edge along which said film is fed into the developing liquid to define a guiding surface for said film; and a partition plate is attached to the rear edges of said guide plates and extends completely across the developing tank to divide the horizontal section of said tank and surface of the developing liquid therein.

2. A film developing tank according to claim 1, wherein said partition plate passes completely across the tank to divide its cross-section at a certain height into two.

3. A film developing tank having a conveyor means which comprises a guide member having front and rear surfaces, feeding rollers by which a film to be developed is fed along the front surface of said guide member to introduce said film into developing liquid in said developing tank on one side of said guide member, and squeezing rollers for squeezing film discharged from said developing liquid on the opposite side of said guide member characterized in that:

said guide member is a plate having an arc-shaped front surface which acts simultaneously as a partition plate and extends across the entire width of the tank, said front surface being continuous at the surface of developing liquid in said tank to divide said surface and said front surface being provided with a plurality of longitudinal slits above the surface of developing liquid which slits are parallel to one another and each of them having the same arc-shaped curve as that of the front surface on said partition plate to ensure said film only contacts with a small part of the front surface.

4. A film developing tank according to claim 3, wherein said guide plate divides a cross-section of said film developing tank at a certain height into two.

* * * * *